US011584480B2

(12) United States Patent
Byrd

(10) Patent No.: US 11,584,480 B2
(45) Date of Patent: Feb. 21, 2023

(54) LIGHTSCAPE DISPLAY SYSTEM

(71) Applicant: David A. Byrd, Craigville, IN (US)

(72) Inventor: David A. Byrd, Craigville, IN (US)

( * ) Notice: Subject to any disclaimer, the term of this patent is extended or adjusted under 35 U.S.C. 154(b) by 122 days.

(21) Appl. No.: 17/142,895

(22) Filed: Jan. 6, 2021

(65) Prior Publication Data

US 2021/0206455 A1 Jul. 8, 2021

Related U.S. Application Data

(60) Provisional application No. 62/957,525, filed on Jan. 6, 2020.

(51) Int. Cl.

| | |
|---|---|
| ***B63B 22/16*** | (2006.01) |
| ***B63B 22/04*** | (2006.01) |
| ***B63B 45/00*** | (2006.01) |

(52) U.S. Cl.

CPC ..... *B63B 22/166* (2013.01); *B63B 22/04* (2013.01); *B63B 45/00* (2013.01)

(58) Field of Classification Search

CPC ..... B63B 22/00; B63B 22/04; B63B 22/16; B63B 22/166; B63B 22/18; B63B 22/20; G09F 21/18

USPC ..... 441/1, 6, 11, 13, 16, 21, 22, 23, 28; 114/264; 40/40, 606.01, 606.08

See application file for complete search history.

(56) References Cited

U.S. PATENT DOCUMENTS

| | | | | |
|---|---|---|---|---|
| 4,103,379 | A * | 8/1978 | Wolfe | B63B 22/18 43/43.11 |
| 4,405,303 | A * | 9/1983 | Smith | B63B 22/18 441/16 |
| 4,544,364 | A * | 10/1985 | Bankston | B63B 22/00 441/16 |
| 4,781,636 | A * | 11/1988 | Schurr | B63B 22/18 242/395 |
| 5,033,984 | A * | 7/1991 | Shroeder | B63B 22/166 441/16 |
| 5,273,468 | A * | 12/1993 | Nichols | B63B 22/08 441/6 |
| 5,358,437 | A * | 10/1994 | Allen | B63B 22/18 441/13 |
| 7,337,568 | B2 * | 3/2008 | Johnson | G09F 21/18 40/606.01 |
| 7,413,319 | B2 * | 8/2008 | Longoria | G09F 13/24 362/267 |
| 7,824,238 | B1 * | 11/2010 | Winter | B63B 22/08 441/6 |
| 7,967,651 | B2 * | 6/2011 | Koulouris | B63C 9/04 441/80 |

FOREIGN PATENT DOCUMENTS

| | | | | |
|---|---|---|---|---|
| JP | H0858678 A * | 3/1996 | | B63B 22/16 |

* cited by examiner

*Primary Examiner* — Daniel V Venne
(74) *Attorney, Agent, or Firm* — Taylor IP, P.C.

(57) ABSTRACT

A display system for use in a pool or a small body of water. The display system including an anchor, a floating platform tethered to the anchor, and at least one display element. The floating platform is generally flat. The generally flat floating platform provides buoyancy. The display element protruding up from the floating platform.

15 Claims, 6 Drawing Sheets

LIGHTSCAPE DISPLAY SYSTEM

CROSS REFERENCE TO RELATED APPLICATIONS

This is a non-provisional application based upon U.S. provisional patent application Ser. No. 62/957,525, entitled "LANDSCAPE DISPLAY SYSTEM", filed Jan. 6, 2019, which is incorporated herein by reference.

BACKGROUND OF THE INVENTION

1. Field of the Invention

The present invention relates to a buoyant display for use in a pool or small body of water.

2. Description of the Related Art

Navigation buoys are used to direct shipping, and consist of a floating portion that extends above the water to draw attention and an anchor to hold them in position. Some buoys float with the currents to gather scientific data.

Around pools and ponds there are often decorative items such as waterfalls, rock arrangements and positioned displays to enhance the enjoyment of the environment. There are floating rafts, floating lounges with drink holders that are interactively used by people at and in the water.

What is needed in the art is a buoyant display for emblems and the like so that a person can promote their favorite team, school, or cause in the water environment.

SUMMARY OF THE INVENTION

The present invention provides a floating display in a pond or pool, or can be used on land as a landscaping system.

The invention in one form is directed to a display system for use in a pool or a small body of water. The display system including an anchor, a floating platform tethered to the anchor, and at least one display element. The floating platform is generally flat. The generally flat floating platform provides buoyancy. The display element protruding up from the floating platform.

The invention in another form is directed to a display system for use in a pool or a small body of water. The display system including a floating platform, and at least one display element. The floating platform is generally flat. The generally flat floating platform provides buoyancy. The display element protruding up from the floating platform.

The invention in yet another form is directed to a display system used in a pool or a small body of water. The display system including an anchor, a floating platform, at least one display element, a plurality of lights, and a stabilizing member. The floating platform is tethered to the anchor, with the floating platform being generally flat. The generally flat floating platform provides buoyancy, and the floating platform has an axis that is perpendicular the platform. The floating platform is generally symmetrically balanced about the axis. The anchor is tethered to the bottom of the floating platform away from the axis. The at least one display element protrudes up from the floating platform, with the plurality of lights being symmetrically placed on a top surface of the floating platform, the lights illuminating the display item when dark. The stabilizing member is coupled beneath the floating platform, with the stabilizing member being aligned with the axis.

An advantage of the present invention is that the system is easily adaptable to display different flags or display elements.

Another advantage is the display system has lighting to continue the display after the evening arrives.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
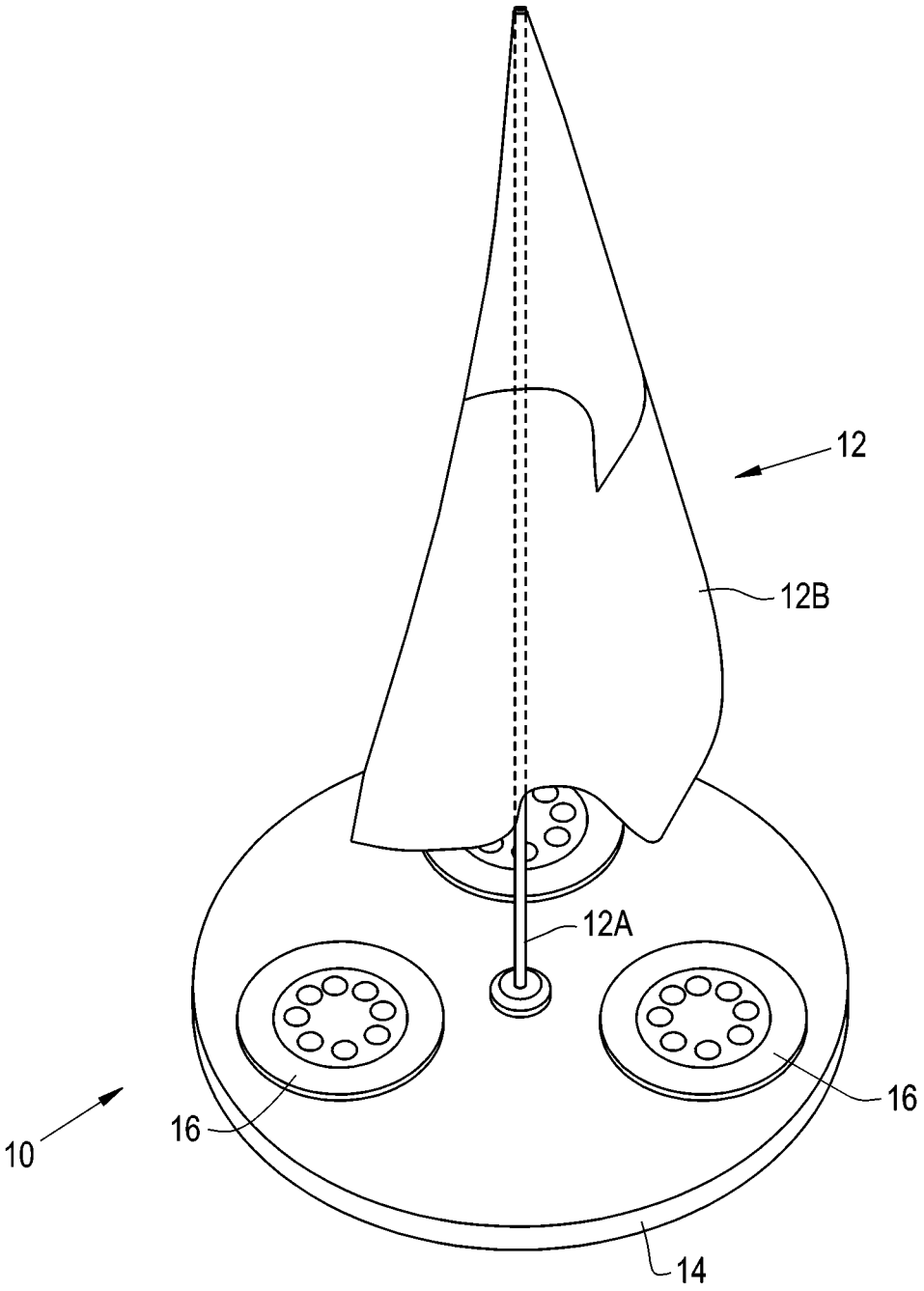
FIG. 1 is a perspective view of an embodiment of a display system of the present invention in the form of a lightscape display system having a flag and three lights coupled to a floating platform.

Referring now to the drawings, and more particularly to FIG. 1, there is shown, a display system 10 including, in this embodiment, a display 12 in the form of a flag display 12, with a mast 12A and a flag 12, a base 14 and lights 16. Flag display 12 is representative of any item 12 that is to be highlighted in system 10. Lights 16 may be visible light emitters and/or non-visible light emitters. Material of item 12 may contain elements that interact to convert non-visible light to visible light so as to enhance the display of item 12, or certain aspects of item 12.

Figure 2:
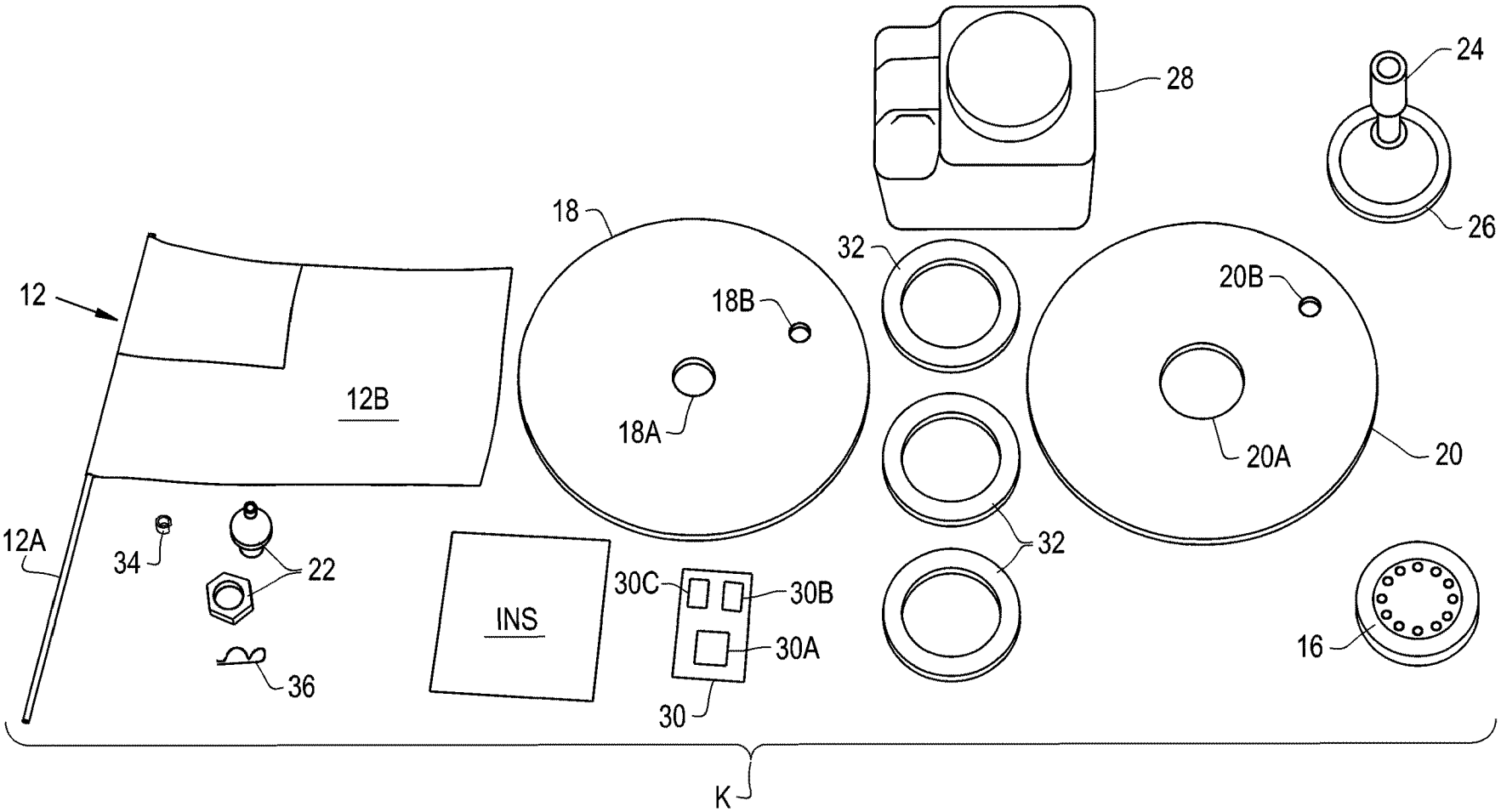
FIG. 2 is a perspective view of an embodiment of a kit of the components that make the lightscape system of FIG. 1.

Now, additionally referring to FIG. 2, there is shown various elements of display system 10, with display item 12, which may be in the form of an American flag 12B that is slipped onto mast 12A, although other flags or display items 12 are contemplated, such as NFL, College, Harley Davidson flags or symbols. Other elements illustrated include a light 16, a plate 18, a floatation member 20, holder 22, an extended member 24, a stabilizing plate 26, an anchor 28, a bag 30, and a bag INST. Holder 22 is coupled together through hole 18A and mast 12A is inserted into holder 22 to hold display 12. Holder 22 is shown as two pieces, which can be injection molded, with the top portion being threaded externally and internally and the bottom portion being a nut that is used to secure holder 22 to plate 18. The pieces of holder 22 are screwed together, with element 18 sandwiched therebetween, and may have a small bit of glue added to keep the threads locked in place. Anchor weight 28, which may be a jar or a jug 28 with sand or rocks being added to achieve the required ballast weight. Bag INST containing the instructions for kit K shown in FIG. 2. In bag 30 is a clip 30B, a swivel 30C and fishing line 30A, shown schematically. Clip 30B is connected to one end of fishing line 30A and swivel 30C is connected to either the other end of line 30A or to clip 30B. Clip 30B is coupled to the bottom of platform 14. Swivel 30C is normally connected to clip 30B but can be connected to the anchor. Swivel 30C connects to clip 30B to limit twisting in line 30A.

Platform 14 includes plate 18 with flotation member 20 coupled therebeneath. Plate 18 and member 20 may be coupled with adhesive or may be integral, with platform 14 providing an upper surface and flotation of display system 10. Rings 32 can be adhered to plate 18 with lights 16 inserted therein, or lights 16 may be directly adhered to plate 18. Lights 16 can be in the form of solar lights 16 with solar cells being integral therewith. It is also contemplated that the present invention can be used on a patio, or as part of a landscaping display, without the used of anchor 28.

Center holes 18A and 20A accommodate holder 22. Extended member 24 can be threaded to the bottom of holder 22, with plate 26 being coupled to member 24. Holes 18B and 20B accommodate clip 30B so that anchor 28, by way of line 30A, serves to position system 10 where desired in a body of water. A C-clip 34 is used to secure flag 12B to mast 12A by being clipped over flag 12B where mast 12A is inserted into flag 12B. An R-clip 36 is inserted through holder 22 and mast 12A to secure item 12 to holder 22. Flag 12B has a blind sleeve into which mast 12A is inserted and C-clip 34 is clipped around the opening of the sleeved to secure flag 12B to mast 12A. The top of mast 12A has the dead-end of the blind sleeve resting thereon, with this configuration allowing for the easy replacement of flag 12B, by way of removing C-clip 34, sliding current flag 12B off of mast 12A, sliding a blind sleeve of a new flag 12B onto mast 12A and securing the bottom of the sleeve to mast 12A by reinstalling C-clip 34. The tethering of system 10 is illustrated away from axis A to accommodate windy conditions, it is also contemplated that the tethering can be centrally located when wind is of little or no concern.

Figure 3:
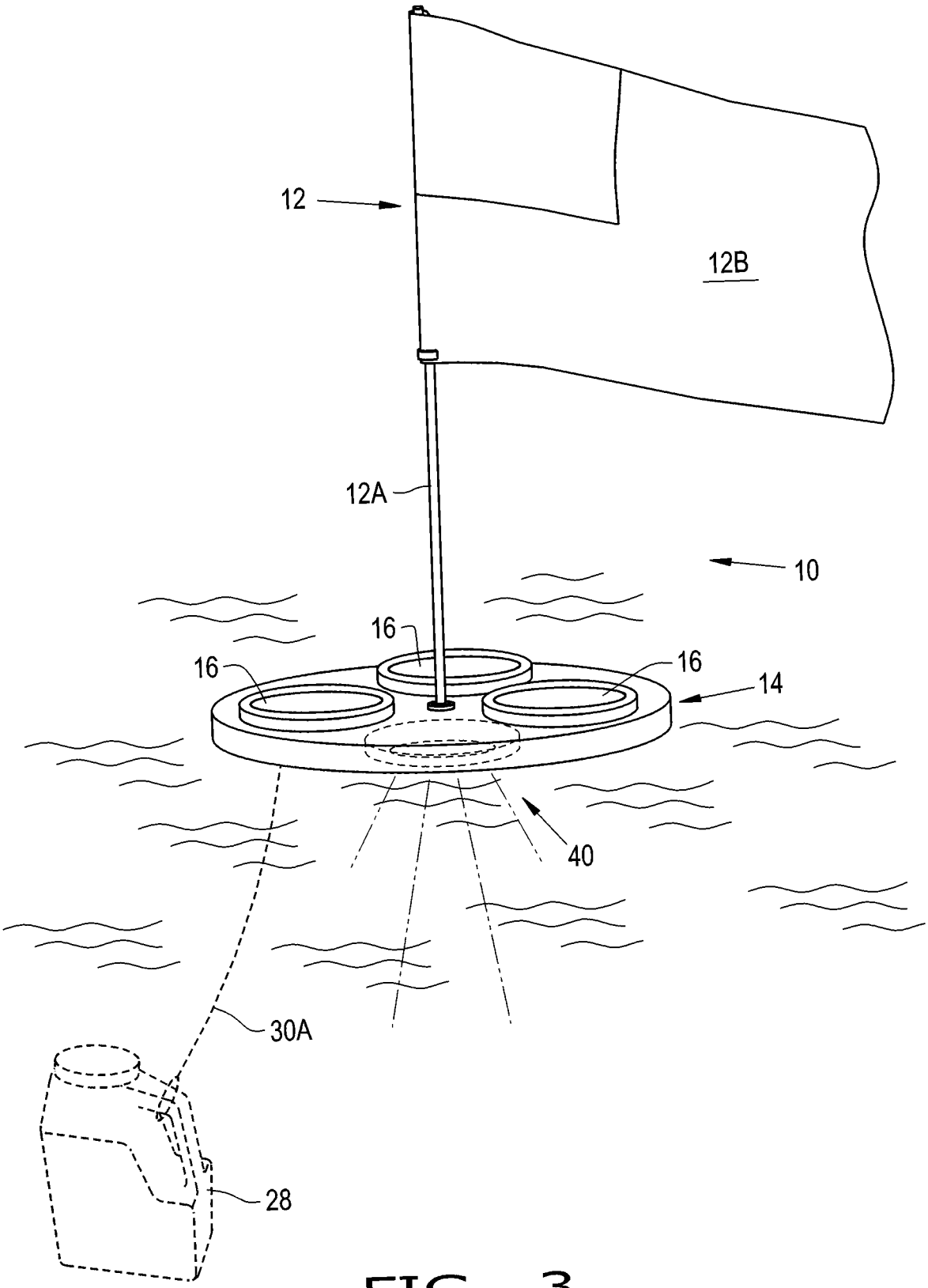
FIG. 3 is another perspective view of the lightscape system of FIGS. 1 and 2.

Now, additionally referring to FIG. 3 there is shown a display system 10 floating in water, system 10 has been constructed from the items displayed in FIG. 2, and additionally has a downwardly oriented light 40. Light 40 is coupled to holder 22, or is coupled to the bottom of platform 14. Anchor 28 is resting on the bottom of the water and serves to position display system 10 in position.

Figure 4:
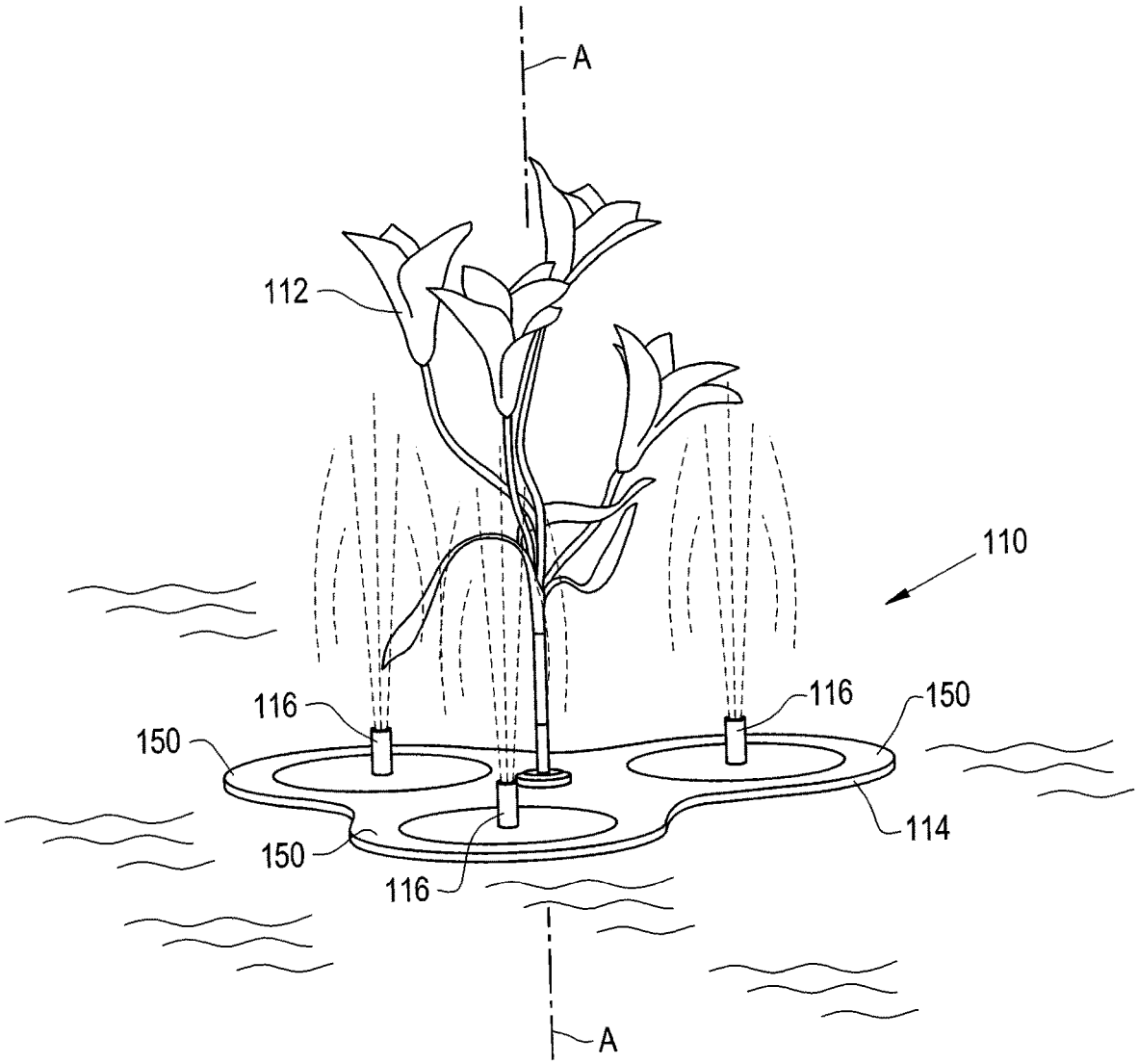
FIG. 4 is another perspective view of another embodiment of the lightscape system of the present invention, with water fountains.

Now, additionally referring to FIG. 4, there is shown another embodiment of the display system, specifically in the form of display system 110, with elements similar in nature to system 10. Here illustrated with a flower item 112, a three lobed base 114 and solar powered fountains 116. It is contemplated that fountains 116 may also have lights associated with them for a nighttime display. Similar features have had 100 added to their reference number.

Figure 5:
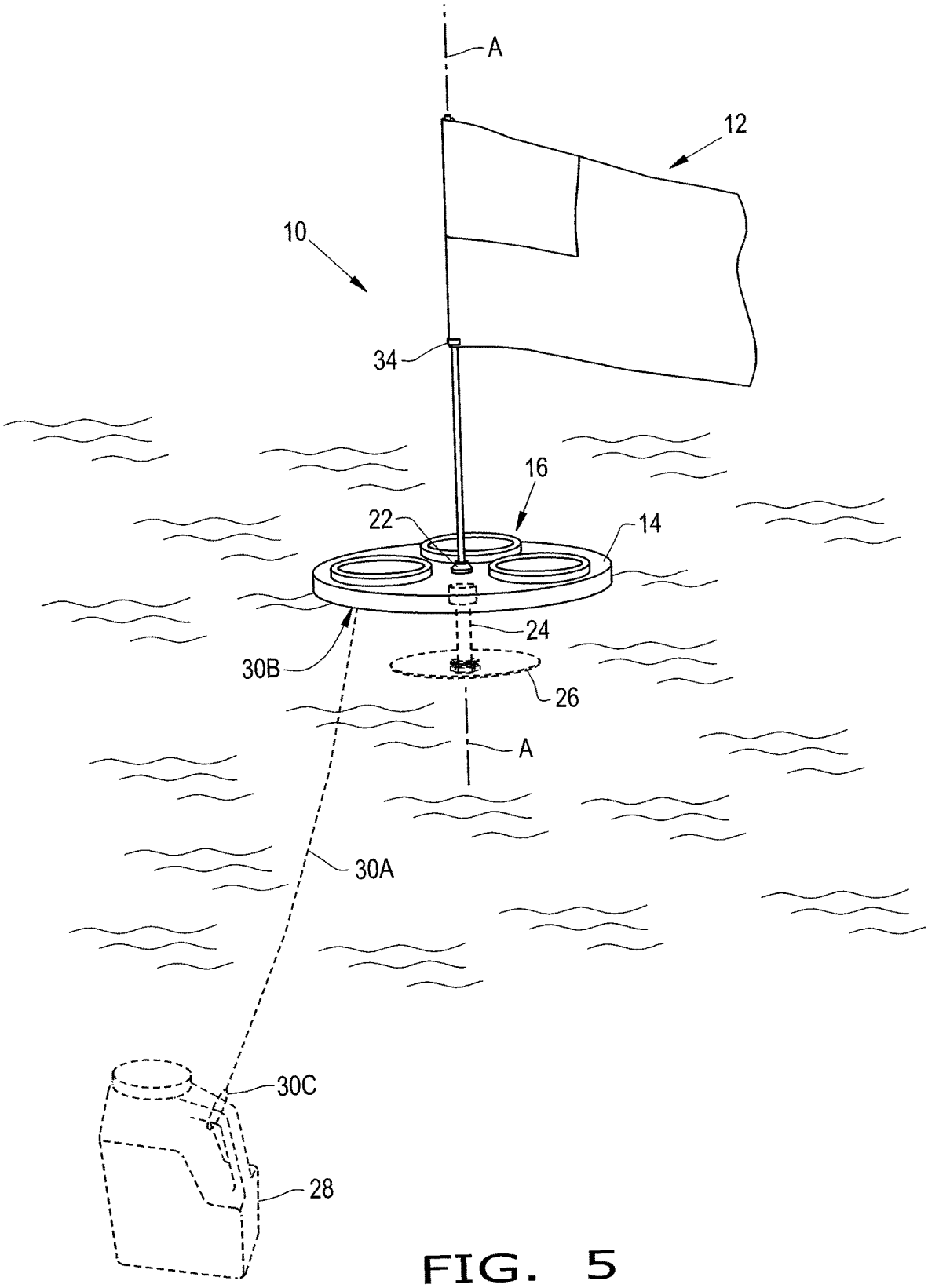
FIG. 5 illustrates the display system of the previous Figs. with a stabilizing feature coupled thereto.

Now, additionally referring to FIG. 5, there is illustrated display system 10 having extender member 24 and stabilizing plate 26 installed to provide stability to system 10 as it floats in the water. Extender member 24 may be threaded to holder 22. When the turbulence of the water increases plate 26 serves to dampen the effects of the turbulence and thereby stabilize system 10.

Figure 6:
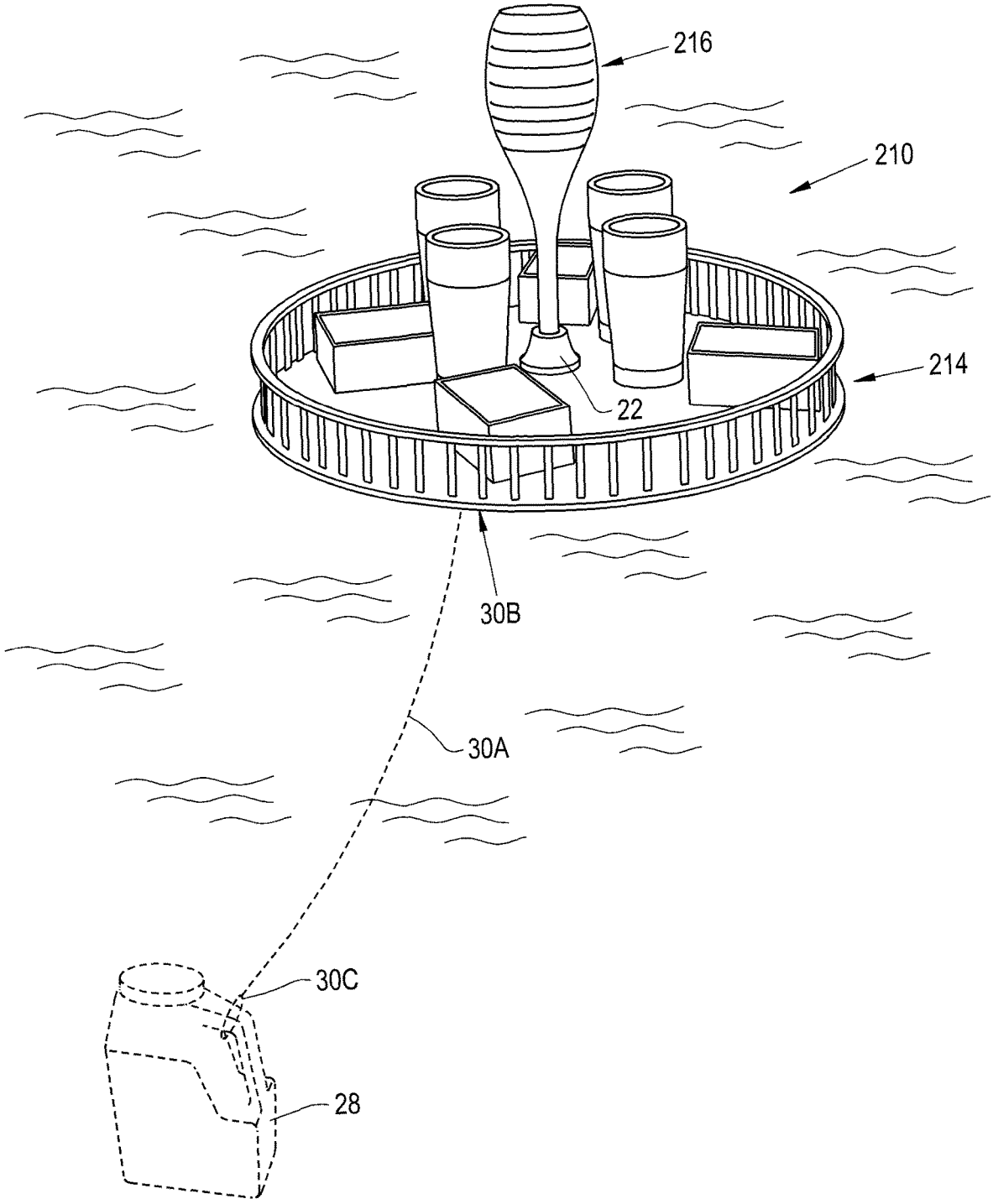
FIG. 6 illustrates another embodiment of the display system of the previous Figs. here with a central light and a short railing to retain food and drink contained thereon.

Now, additionally referring to FIG. 6 there is illustrated another embodiment of the present invention in the form of a display system 210, with similar items having 200 added to the reference numbers. Here platform 214 serves as a food and beverage holder, with cups and rectangular food containers being illustrated thereon. Platform 214 here is shown with a railing the extends proximate to the outer circumference of platform 214. Here light 216 is positioned in the middle of platform 214 and is coupled to holder 22. Light 216 is positioned to provide light to platform 214 and generally outward as a display feature itself.

Floating platform 14 has an axis A that is perpendicular to platform 14, and floating platform 14 is generally symmetrically balanced about axis A. As is seen in FIG. 4 floating platform 114 has multiple lobes 150, and lobes 150 are balanced about axis A. While lobes 150 are illustrated as being geometrically balanced about axis A, it is also contemplated to have lobes or extensions that are not geometrically balanced, but are flotationally balanced about axis A.

Anchor 28 is tethered to the bottom of floating platform 14 at hole 18B away from axis A and is also away from an outer circumferential edge of floating platform 14. Display element 12 can be a flag, a symbol, flower, a light, or a like item that is desired to be coupled to platform 14 for the purpose of displaying the item 12. Lights 16 and/or fountains 116 are symmetrically placed on a top surface of floating platform 14, the lights 16 being used to illuminate display item 12 when dark. The number of lights 16, or fountains 116 can vary and the positioning of them will generally be symmetrical about axis A.

Stabilizing member 24, 26 is coupled beneath floating platform 14, and stabilizing member 24, 26 is aligned with axis A. Stabilizing member 24, 26 has a profile of an inverted-T, with member 26 acting to dampen movements of platform 14. A light 40 can be coupled to either member 26 or to holder 22 and be symmetrically positioned beneath floating platform 14, with illumination from light 40 being generally directed downwardly.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A display system for use in a pool or a small body of water, the display system comprising:

an anchor;

a floating platform tethered to the anchor, the floating platform being generally flat, the generally flat floating platform providing buoyancy; and at least one display element protruding up from the floating platform, wherein the floating platform has an axis that is perpendicular thereto, the floating platform being generally symmetrically balanced about the axis, wherein the floating platform has multiple lobes, the lobes being balanced about the axis.

2. The display system of claim 1, wherein the anchor is tethered to the bottom of the floating platform away from the axis.

3. The display system of claim 2, wherein the anchor is tethered away from an outer circumferential edge of the floating platform.

4. The display system of claim 3, wherein the display element is a flag or a symbol.

5. The display system of claim 3, wherein the display element is a light.

6. The display system of claim 3, further comprising a plurality of lights symmetrically placed on a top surface of the floating platform, the lights illuminating the display item when dark.

7. The display system of claim 1, further comprising a stabilizing member coupled beneath the floating platform, the stabilizing member being aligned with the axis.

8. The display system of claim 1, further comprising a light symmetrically positioned beneath the floating platform, illumination from the light being generally directed downwardly.

9. A display system for use in a pool or a small body of water, the display system comprising:

a floating platform, the floating platform being generally flat, the generally flat floating platform providing buoyancy; and at least one display element protruding up from the floating platform, wherein the floating platform has an axis that is perpendicular thereto, the floating platform being generally symmetrically balanced about the axis, wherein the floating platform has multiple lobes, the lobes being balanced about the axis.

10. The display system of claim 9, wherein the display element is a flag or a symbol.

11. The display system of claim 9, wherein the display element is a light.

12. The display system of claim 9, further comprising a plurality of lights symmetrically placed on a top surface of the floating platform, the lights illuminating the display item when dark.

13. The display system of claim 9, further comprising a stabilizing member coupled beneath the floating platform, the stabilizing member being aligned with the axis.

14. A display system for use in a pool or a small body of water, the display system comprising:

a floating platform, the floating platform being generally flat, the generally flat floating platform providing buoyancy;

at least one display element protruding up from the floating platform; and a stabilizing member coupled beneath the floating platform, the stabilizing member being aligned with the axis, wherein the stabilizing member has an inverted T profile.

15. The display system of claim 9, further comprising a light symmetrically positioned beneath the floating platform, illumination from the light being generally directed downwardly.

* * * * *